US006978652B1

(12) United States Patent
Meis

(10) Patent No.: US 6,978,652 B1
(45) Date of Patent: Dec. 27, 2005

(54) TOOLS FOR USE WITH A VEHICLE HOLDING SYSTEM

(76) Inventor: William J. Meis, 23590 Old Lincoln Hwy., Crescent, IA (US) 51526

( * ) Notice: Subject to any disclaimer, the term of this patent is extended or adjusted under 35 U.S.C. 154(b) by 0 days.

(21) Appl. No.: 10/727,307

(22) Filed: Dec. 4, 2003

(51) Int. Cl.[7] ..... B21J 13/08
(52) U.S. Cl. ..... 72/457; 72/705; 248/352
(58) Field of Search ..... 72/295, 298, 457, 72/705; 248/352, 500, 544, 637, 649; 269/58, 269/74, 76, 309, 311

(56) References Cited

U.S. PATENT DOCUMENTS 4,557,127 A * 12/1985 Pietrelli ..... 72/31.02
4,898,019 A * 2/1990 Rich ..... 72/461
5,054,307 A * 10/1991 Wisner ..... 72/457
5,413,303 A * 5/1995 Lee ..... 248/354.1
5,415,023 A * 5/1995 Hinson ..... 72/457
6,098,445 A 8/2000 Meis ..... 72/457
6,185,982 B1 * 2/2001 Ballard et al. ..... 72/457
6,568,237 B1 * 5/2003 Graham et al. ..... 72/457

* cited by examiner

*Primary Examiner*—Ed Tolan
(74) *Attorney, Agent, or Firm*—Thomte, Mazour & Niebergall; Dennis L. Thomte

(57) ABSTRACT

Tools are described which may be secured to blocking sockets of a vehicle holding system for use with a vehicle frame straightener. Each of the tools is designed to block and hold the frame of a vehicle during the frame straightening procedure.

18 Claims, 11 Drawing Sheets

TOOLS FOR USE WITH A VEHICLE HOLDING SYSTEM

BACKGROUND OF THE INVENTION

1. Field of the Invention

This invention relates to a vehicle holding system and more particularly to a vehicle holding system for use on a drive-on frame rack. More particularly, the invention relates to a vehicle holding system such as disclosed in U.S. Pat. No. 6,098,445. Even more particularly, the invention relates to tools for holding the frame of a vehicle positioned on a frame rack.

2. Description of the Related Art

Frame racks are used to straighten the frames of damaged or wrecked vehicles. The conventional frame racks of the drive-on type normally include a vehicle supporting rack means having one or more pulling towers positioned adjacent thereto. The pulling towers have chains extending therefrom for connection to the frame to pull the frame into alignment. A problem associated with the conventional frame racks is that there is not an adequate means for blocking or locking the frame of the vehicle into position during the pulling operation. The lack of an adequate vehicle holding system for use with drive-on frame racks results in a less than efficient frame rack. In some cases, in an effort to hold the vehicle into position during the pulling operation, several chains are utilized in a futile attempt to hold the frame into position. Sometimes, blocks of wood are also utilized in an attempt to prevent the frame from being pulled downwardly during the pulling operation. The vehicle holding system of applicant's prior U.S. Pat. No. 6,098,445 solved many of the problems of the prior art. The tools disclosed herein enhance the system of U.S. Pat. No. 6,098,445 as well as other types of holding systems.

SUMMARY OF THE INVENTION

A vehicle holding system is described for use with a vehicle frame straightening apparatus including a vehicle supporting rack means having a forward end, a rearward end, opposite sides, an upper surface, and one or more pulling towers positioned adjacent thereto. The vehicle holding system of this invention normally includes at least one elongated cross bar or support member which is selectively positioned on the upper surface of the rack means and which extends between the sides thereof with the ends of the cross bar being secured to the sides of the rack means. One or more upstanding blocking sockets or supports are selectively slid ably mounted on the cross bar which have a socket formed in the upper end thereof for removably receiving a variety of blocking or holding members therein. The lower end of the blocking socket has an opening formed therein which selectively slidably receives the cross bar. Any number of different blocking or holding members may be installed in the socket of the upstanding blocking socket to block and lock the frame of the vehicle in place during the frame pulling or straightening operation.

The instant invention relates to tools which may be used in the blocking sockets of the system of U.S. Pat. No. 6,098,445 or any other system utilizing blocking sockets. The tools of this invention block and lock the frame of the vehicle in place during the frame pulling or straightening operation.

It is a principal object of the invention to provide an improved vehicle holding system for use with a vehicle frame straightening apparatus.

A further object of the invention is to provide a pair of tools for use with a vehicle frame straightening apparatus.

These and other objects will be obvious to those skilled in the art.

DESCRIPTION OF THE PREFERRED EMBODIMENT

Figure 1:
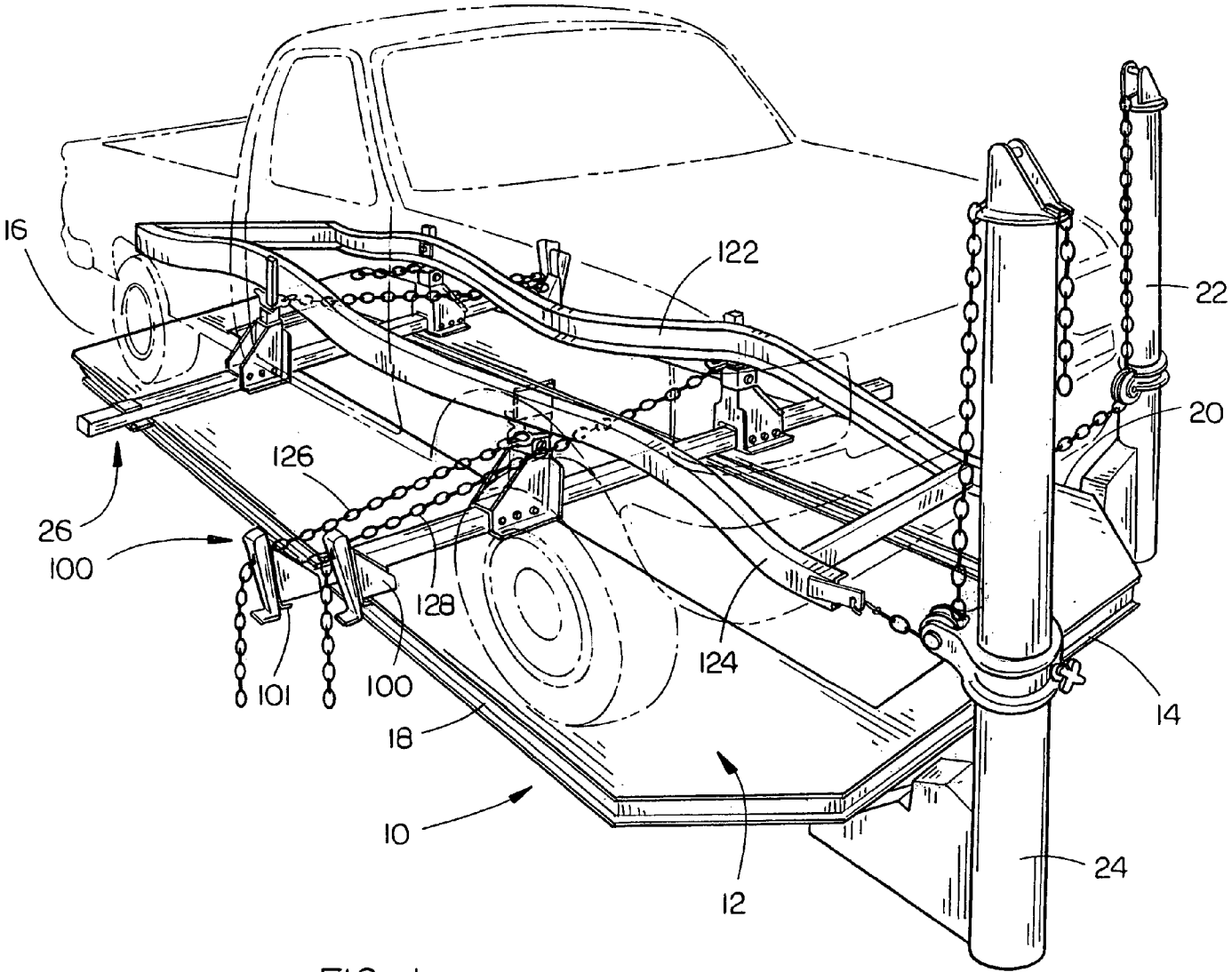
FIG. 1 (PRIOR ART)
FIG. 1 is a perspective view of a conventional drive-on frame rack which is used to repair or straighten the frame of a damaged or wrecked vehicle with the broken lines indicating a truck mounted thereon.
Figure 2:
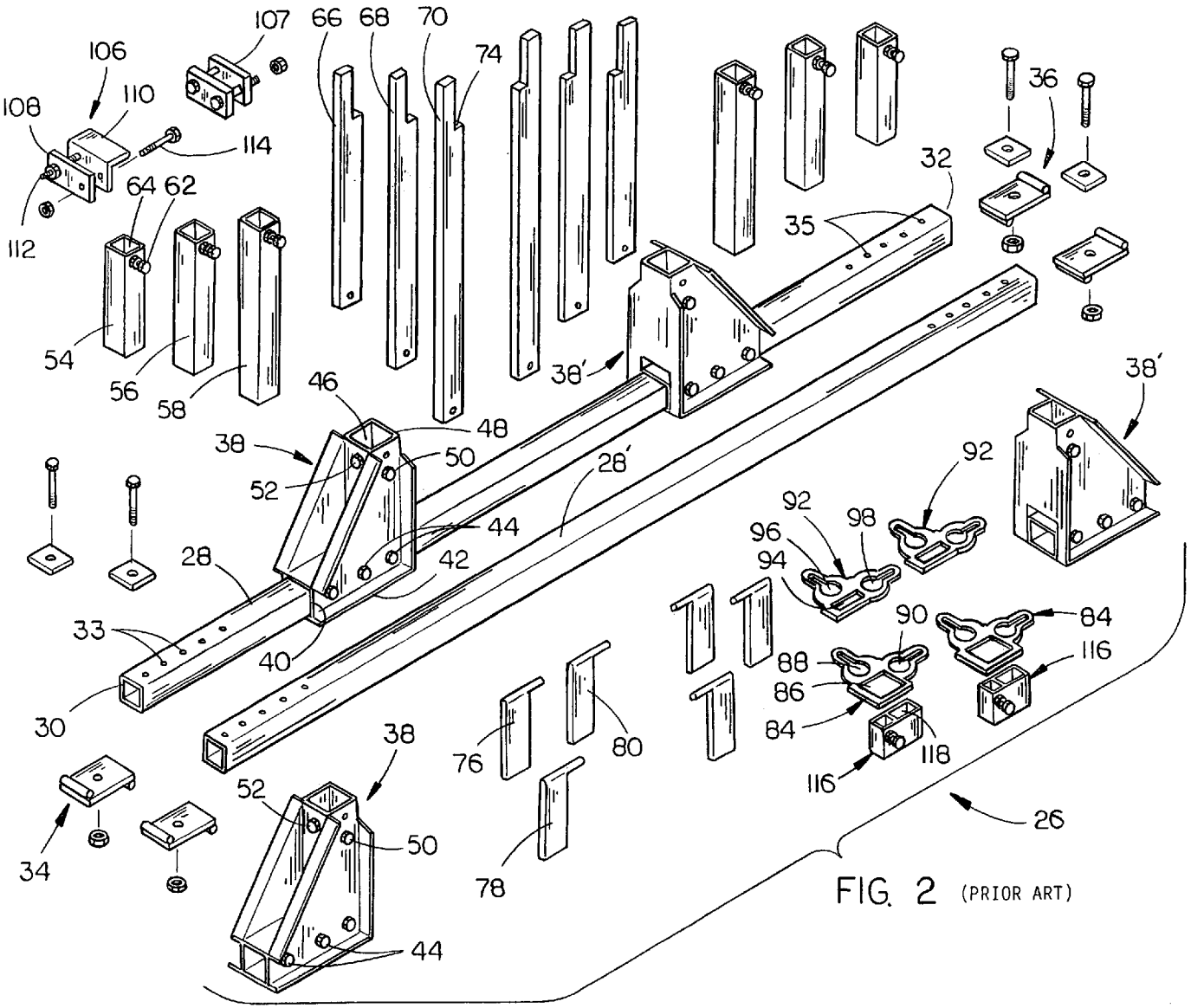
FIG. 2 (PRIOR ART)
FIG. 2 is a perspective view of the components of the vehicle holding system of U.S. Pat. No. 6,098,445.
Figure 3:
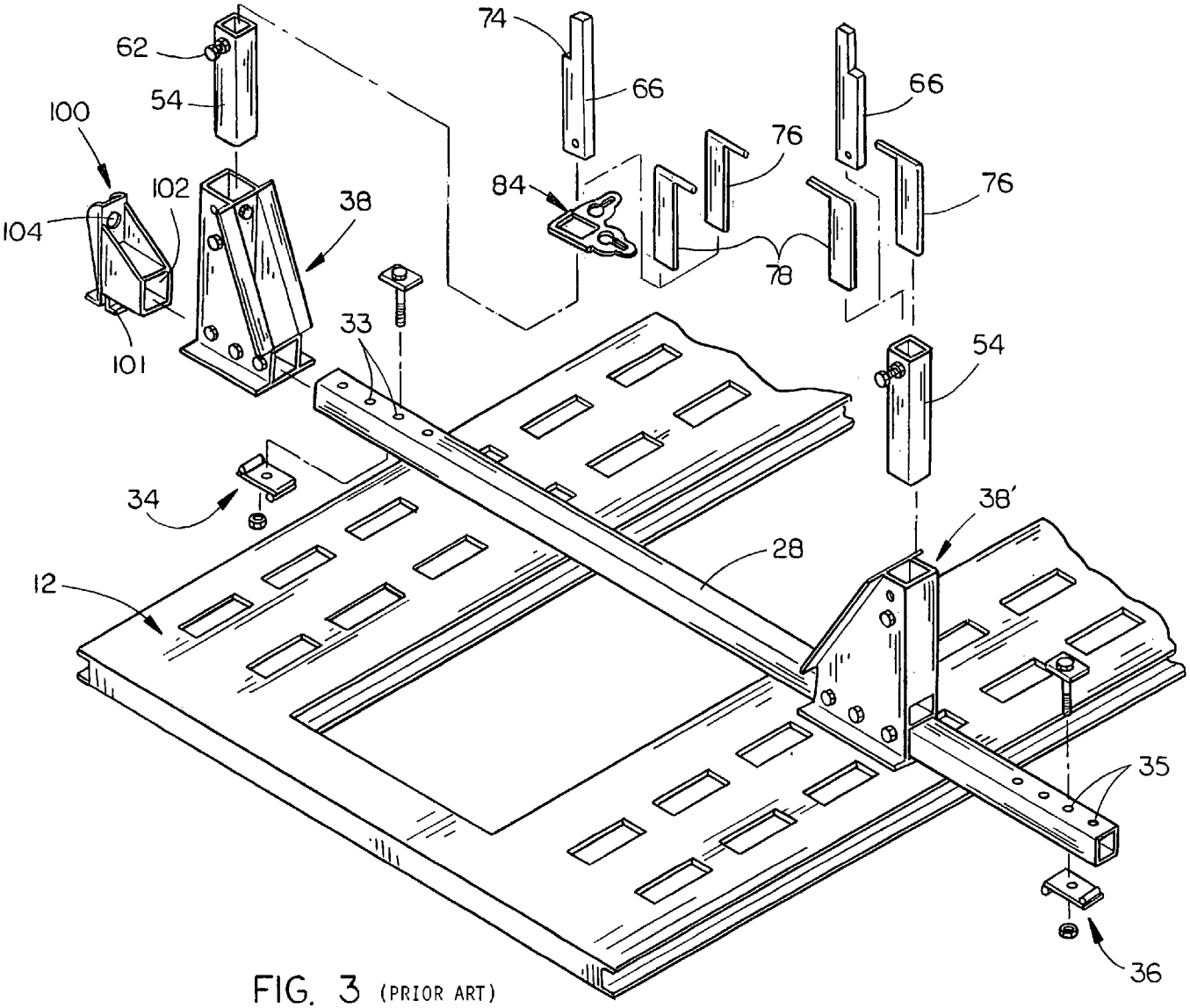
FIG. 3 (PRIOR ART)
FIG. 3 is a partial exploded perspective view illustrating components of the system of U.S. Pat. No. 6,098,445 and their relationship to the frame rack.

FIGS. 1–6 illustrate the system of U.S. Pat. No. 6,098,445 while FIGS. 7–12 illustrate tools for use with the system of U.S. Pat. No. 6,098,445 as well as other frame straightening systems. Referring to FIGS. 1–6, the numeral 10 refers to a conventional drive-on frame rack which is used to repair or straighten the frame of a damaged or wrecked vehicle. Rack 10 includes a vehicle supporting rack means 12 having a forward end 14, rearward end 16, opposite sides 18 and 20, and pulling towers 22 and 24 positioned adjacent thereto. The number of pulling towers will vary with the particular rack. The frame rack described hereinabove is of conventional design.

Figure 4:
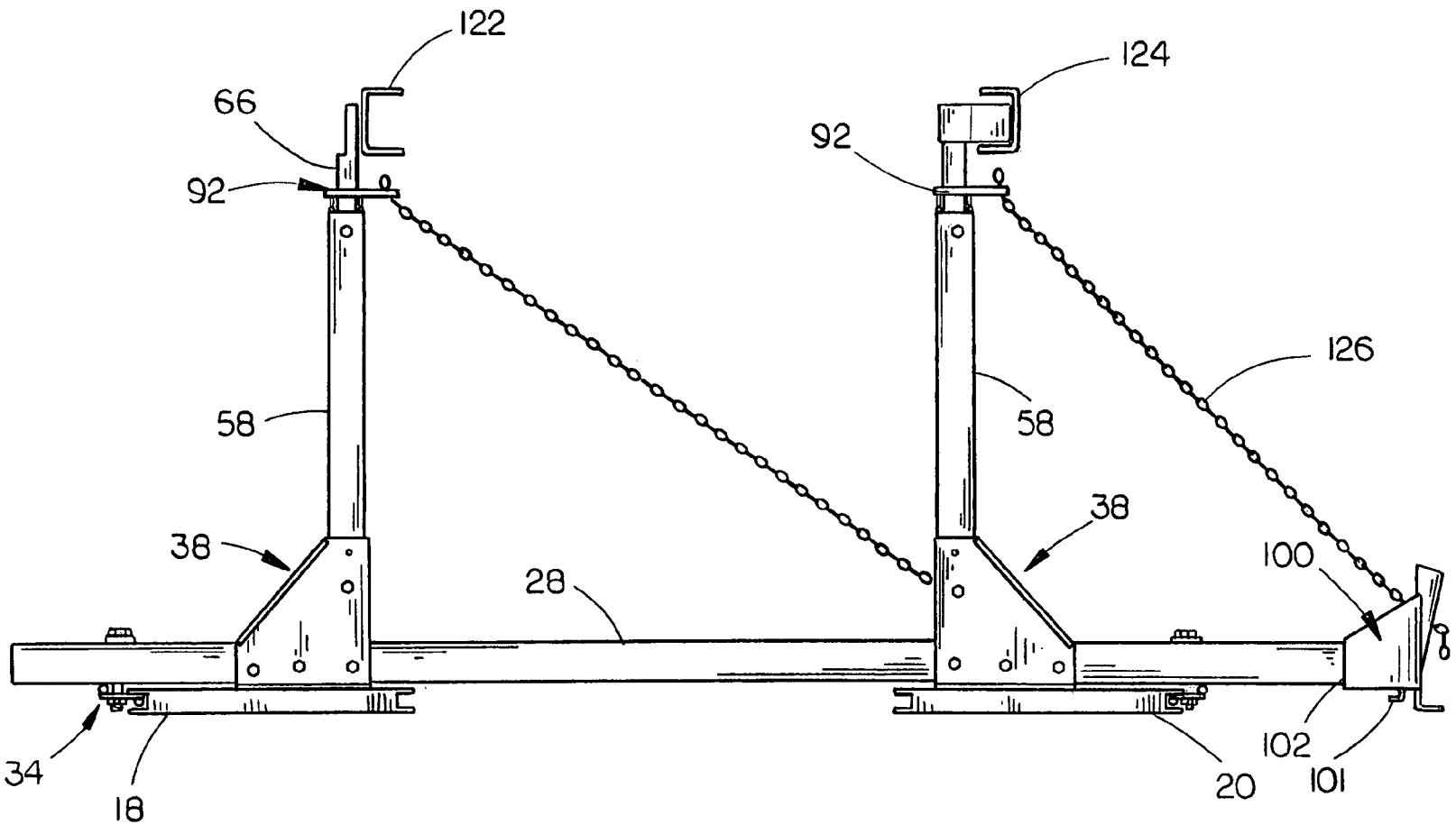
FIG. 4 (PRIOR ART)
FIG. 4 is an end view illustrating components of the system of FIG. 4 mounted on a frame rack.

The universal vehicle holding system of U.S. Pat. No. 6,098,445 is referred to generally by the reference numeral 26 and includes many component parts thereof which will now be described in detail to provide the background for the tools of the instant invention. System 26 includes an elongated cross bar 28 which has a generally square cross section. The ends 30 and 32 of cross bar 28 are provided with a plurality of spaced-apart openings 33 and 35 formed therein to enable cross bar tie down assemblies 34 and 36 to be adjustable mounted thereon to secure the ends of the cross bar 28 to the sides 18 and 20 of the rack means 12, respectively, as seen in FIG. 4. Usually, a pair of blocking sockets 38 and 38' are mounted on cross bar 28, but in some situations only a single blocking socket 38 may be used. Inasmuch as blocking sockets 38 and 38' are identical, only blocking 38 will be described in detail with "'" indicating identical structure on blocking socket 38'.

Blocking socket 38 has a square opening 40 formed therein adjacent its lower end 42 which slidably receives cross bar 28 therein. A plurality of bolts 44 are threadably mounted on the side of blocking socket 38 with the inner ends thereof extending into opening 40 to enable blocking socket 38 to be selectively locked in place on cross bar 28. Blocking socket 38 also has a square socket 46 extending downwardly into the upper end 48 thereof. Bolt 50 is threadably mounted on the side of blocking socket 38 with the inner end thereof extending into socket 46 to enable a component positioned in socket 46 to be locked in place therein. Preferably, a bolt 52 is also threadably mounted on blocking socket 38 at the outer end thereof which also extends into socket 46 to further lock the component in socket 46.

Many different types of components or "tools" may be mounted in socket 46. For example, the numerals 54, 56 and 58 refer to socket insert sleeves of different lengths which may be inserted into socket 46. Each of the sleeves 54, 56 and 58 has a bolt 62 threadably mounted thereon at the upper end thereof which extends into the interior 64 of the sleeve to enable a component received in the sleeve to be locked therein. The numerals 66, 68 and 70 refer to blocking uprights of different lengths which may be inserted into any of the socket insert sleeves 54, 56 and 58. As seen, each of the uprights 66, 68 and 70 is provided with a shoulder or ledge 74 adjacent the upper ends thereof. The numerals 76, 78 and 80 refer to socket insert sleeve spacers which are included in the system and which may be inserted into any of the socket insert sleeves 54, 56 or 58. Socket insert blocking sleeve tie back ring 84s include a square opening 86 formed therein to enable ring 84 to be mounted on any of the sleeves 54, 56 and 58. Ring 84 also includes chain retaining openings 88 and 90 to enable a chain to be received thereby. Upright tie back ring 92 includes an opening 94 formed therein to enable the ring 92 to be mounted on any of the blocking uprights 66, 68 and 70. Ring 92 also includes chain retaining openings 96 and 98 formed therein to enable a tie back chain to be received thereby. One or more chain slack removing sockets 100 are also provided in the system for removing slack from a chain. Socket 100 includes an elongated opening 102 formed in its lower end for receiving the end of a cross bar 28. Socket 100 also includes a chain retaining opening 104 formed therein for receiving the end of a chain therein. Socket 100 also includes a bracket 101 extending inwardly from the lower end thereof to enable the socket 100 to be mounted on one of the sides of the rack.

One or more upright locking clamps 106 comprised of clamp members 108 and 110, which may be drawn together by bolts 112 and 114, may be included in the system for mounting on any of the blocking uprights 66, 68 and 70. Additionally, one or more upright locking clamps 107, which may be drawn together by bolts, may also be included in the system for mounting on any of the blocking uprights 66, 68 and 70. Further, a "C" frame attachment 116 may be mounted on any of the uprights 66, 68 and 70 with the opening 118 in the attachment 116 receiving the upright. A set of identical components are also shown in the drawings which may be used with blocking socket 38'. While a single cross bar 28 has been described, the system would also include a second cross bar 28' and a second pair of blocking sockets, as illustrated in the drawings.

FIG. 1 illustrates the system 26 of U.S. Pat. No. 6,098,445 being used with the conventional drive-on frame rack 10 which is being used to repair or straighten the frame of a damaged or wrecked vehicle 120 including a left side frame member 122 and a right side frame member 124. As stated, normally a pair of the cross bars 28 and 28' will be utilized in most pulling operations. Cross bar 28 is extended through the openings 40 in the blocking sockets 38 and 38' with the cross bar 28 being extended beneath the frame of the vehicle in the approximate desired location. Any of the socket insert sleeves 54, 56 and 58 may be inserted into the socket 46 and socket 46', depending upon the particular vehicle frame being straightened. Bolts 50 and 52 are tightened to maintain the socket insert sleeve in the socket 46. Any of the blocking uprights 66, 68 and 70 may be inserted into the open upper end of the socket insert sleeve, depending upon the height of the frame member at the location where the blocking and holding operation will occur.

Normally, a socket insert sleeve spacer 76 will be inserted downwardly into the open upper end of the socket insert sleeve at one side of the blocking upright positioned in the socket insert sleeve, while a second socket insert sleeve spacer will be inserted into the open upper end of the socket insert sleeve at the opposite side of the blocking upright. In some cases, a pair of the socket insert sleeve spacers will be positioned at one side of the blocking upright. Bolt 62 is then tightened to firmly maintain the blocking upright in position in the socket insert sleeve. Assuming that no other attachments are going to be positioned on the blocking upright, the cross bar tie down assemblies 34 and 36 will be clamped onto the opposite sides of the rack to firmly maintain the cross bar 28 in its proper position. The bolts 44 on the blocking sockets will also be tightened to prevent slippage of the blocking socket with respect to the cross bar 28.

In some cases, a chain slack removing socket 100 will be slipped onto the outer end of the cross bar 28, as illustrated in FIG. 1. The chain slack removing socket 100 is utilized when it is desired to utilize an upright tie back ring 92 which has been slipped over the upper end of the blocking upright with the chain 126 extending between a tie back ring 92 and the chain slack removing socket 100. Further, in some cases, a second chain slack removing socket 100 may be utilized with that socket being positioned at the side edge of the rack with the bracket 101 extending beneath the upper surface of the rack. Chain 128 may then be extended between the socket 100 and a tie back ring positioned on the blocking upright positioned outwardly of side frame member 122, as illustrated in FIG. 1. The chains 126 and 128 further stabilize the locking uprights during the subsequent operation. As seen in FIG. 1, the blocking upright 38 at the left side of the vehicle is positioned outwardly of the side frame member 122 in this particular pulling operation. As seen in FIG. 4, in an effort to prevent damage to the inner edges of the side frame member 124, an upright "C" frame attachment 116 is slipped onto the upper end of the upright with the inner end of attachment 116 engaging the inside surface of the frame member 124 rather than the edges of the frame member.

Figure 6:
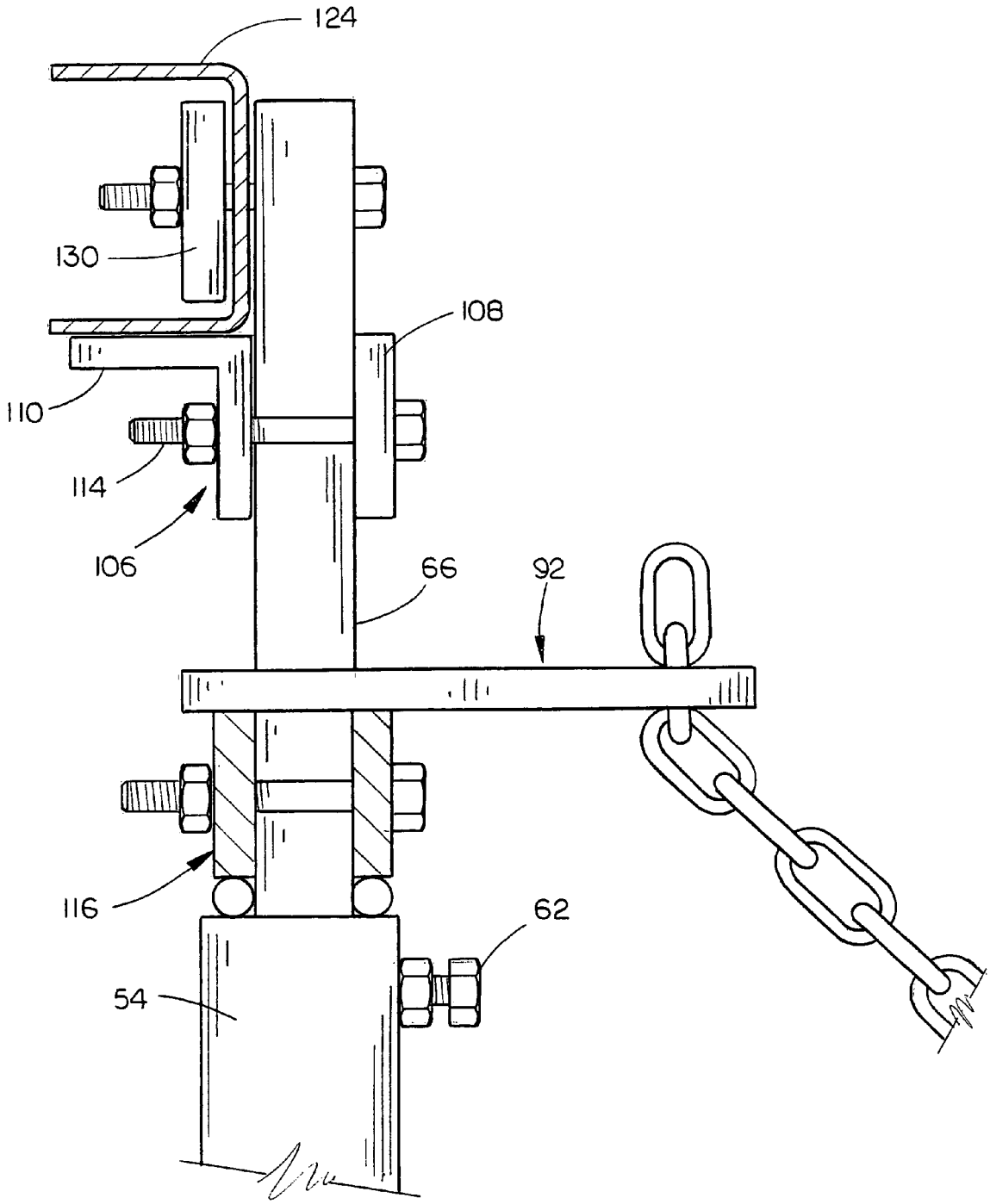
FIG. 6 (PRIOR ART)
FIG. 6 is an end view illustrating certain of the components of the system of U.S. Pat. No. 6,098,445.

FIG. 6 illustrates the manner in which the tie back ring 92 may be vertically positioned on the upright 66. As seen in FIG. 6, an upright locking clamp 106 is clamped onto the upright 66 with the tie back ring 92 being limited in its downward movement by the locking clamp 106. FIG. 6 also illustrates the manner in which a frame member 122 or 124 may also be secured to the upright 66 so that the member 100 is positioned below the frame member 124 to prevent the frame member from being pulled downwardly during the pulling operation. FIG. 6 also illustrates that an upright backing block 130 may be connected to the frame member and the upper end of the upright.

Figure 5:
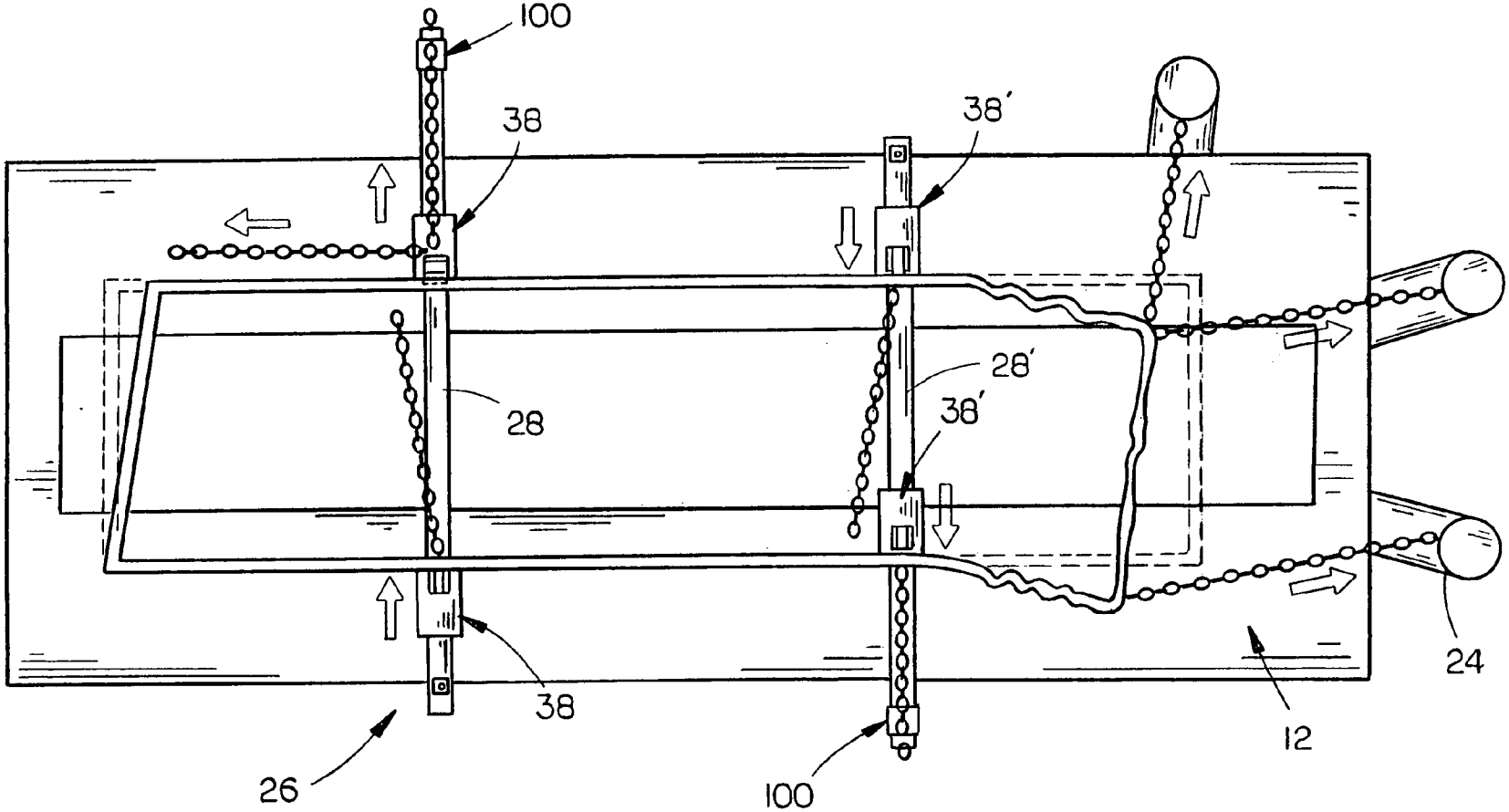
FIG. 5 (PRIOR ART)
FIG. 5 is a top view illustrating the system of U.S. Pat. No. 6,098,445 being used in conjunction with the frame rack.

FIG. 5 illustrates the holding system of this invention being utilized for removing a front end sway and diamond in the frame. The system of this invention is holding the left frame member of the vehicle secure so that it can't move. The system is also holding the rearward end of the right side frame member against outward movement as the pulling operation is being conducted. FIG. 5 also illustrates that the inside of the right side frame member is being held from moving inwardly during the pulling operation, since the upright is positioned at the inside surface of the frame member. The pulling towers then pull the front of the frame to the lift into its correct position, as illustrated by broken lines. The pulling operation also results in the left rear portion of the frame being moved rearwardly to its proper position, as illustrated by broken lines.

FIGS. 7–12 illustrate embodiments of tools which are well suited for use with the system of U.S. Pat. No. 6,098,445 or other frame straightening systems which employ blocking sockets such as blocking sockets 38 illustrated in U.S. Pat. No. 6,098,445 or with other types of sockets.

Figure 7:
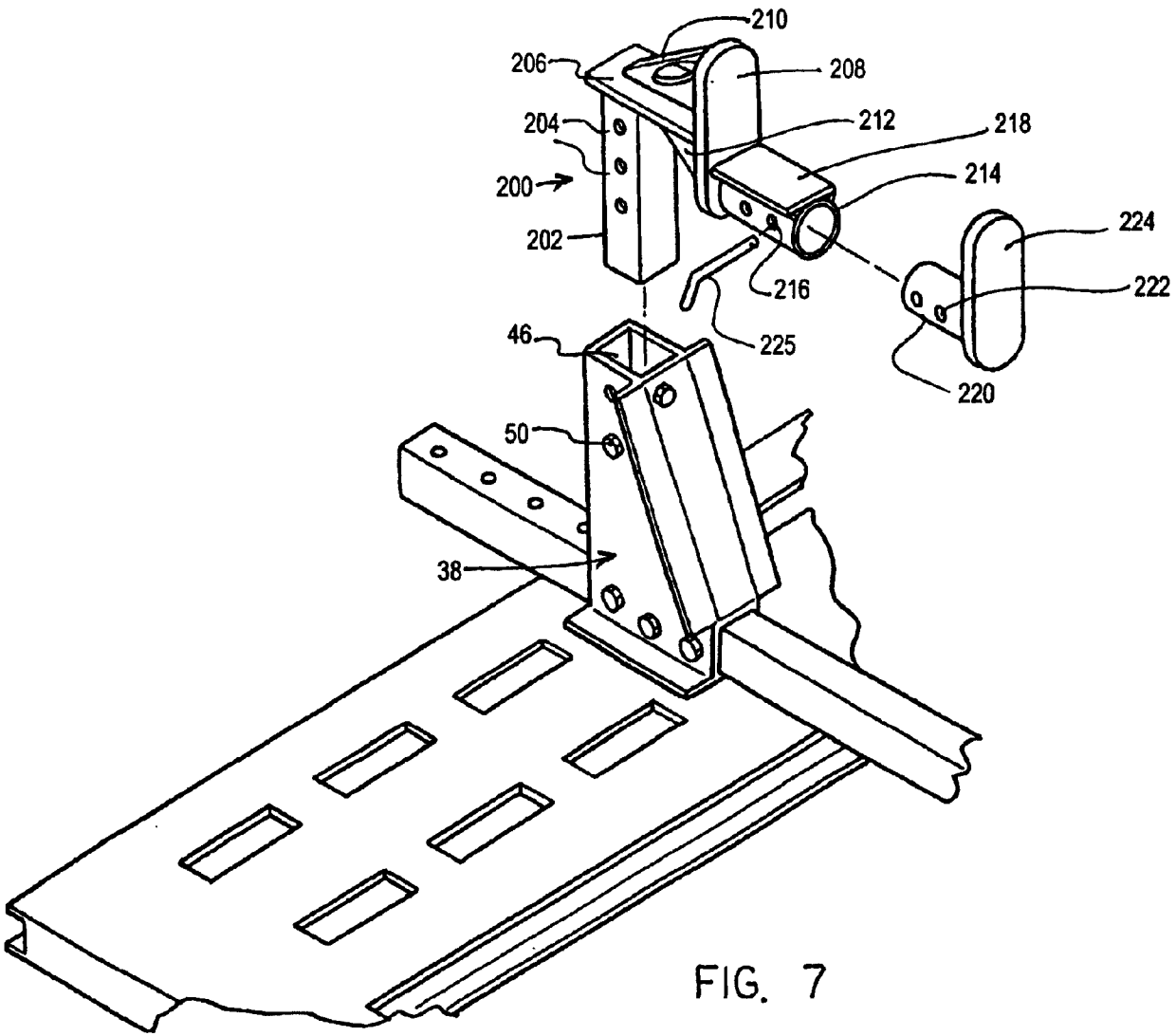
FIG. 7 is an exploded perspective view of one embodiment of the tool of this invention.
Figure 8:
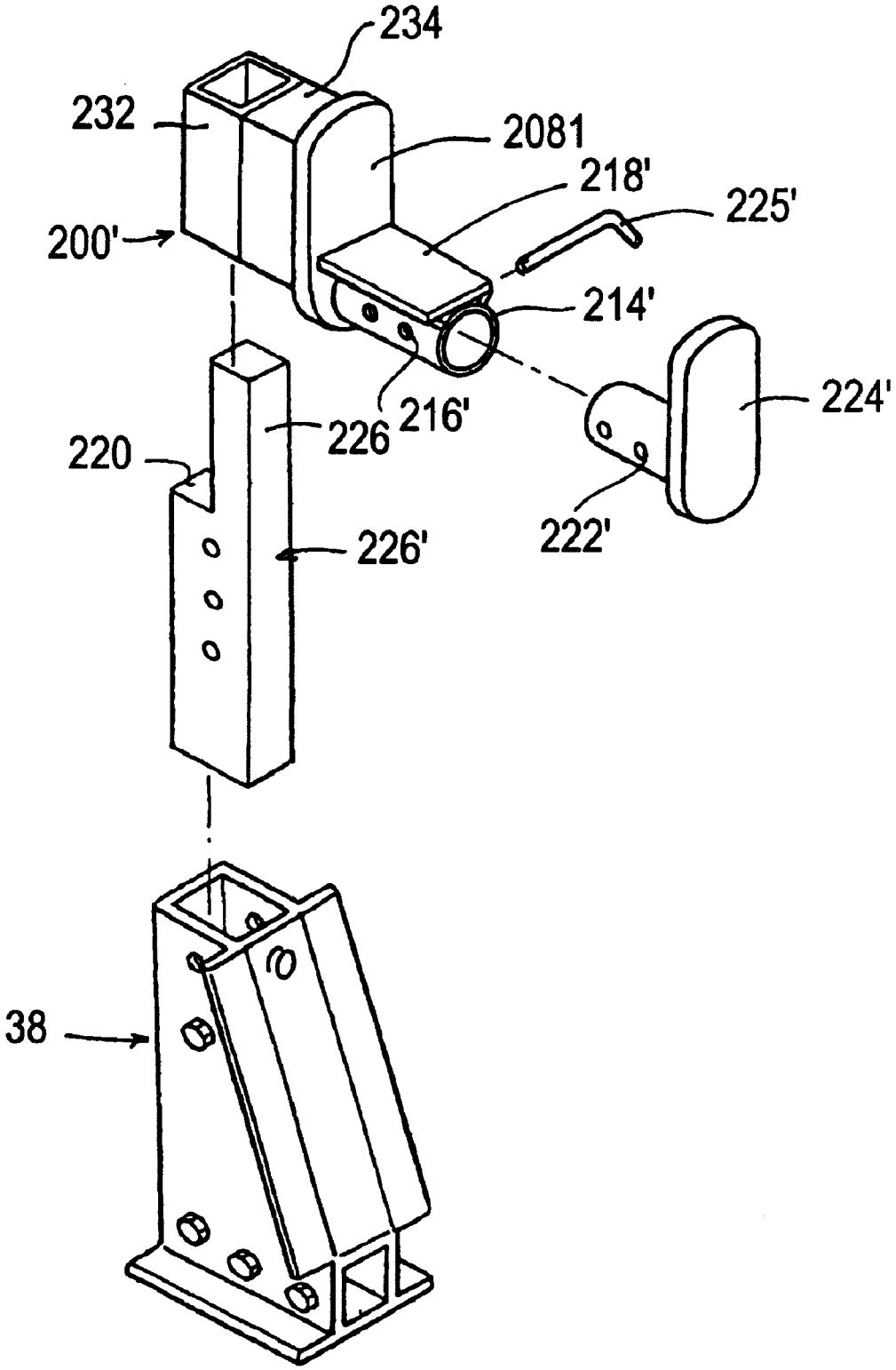
FIG. 8 is an exploded perspective view of a second embodiment of the tool of this invention.
Figure 9:
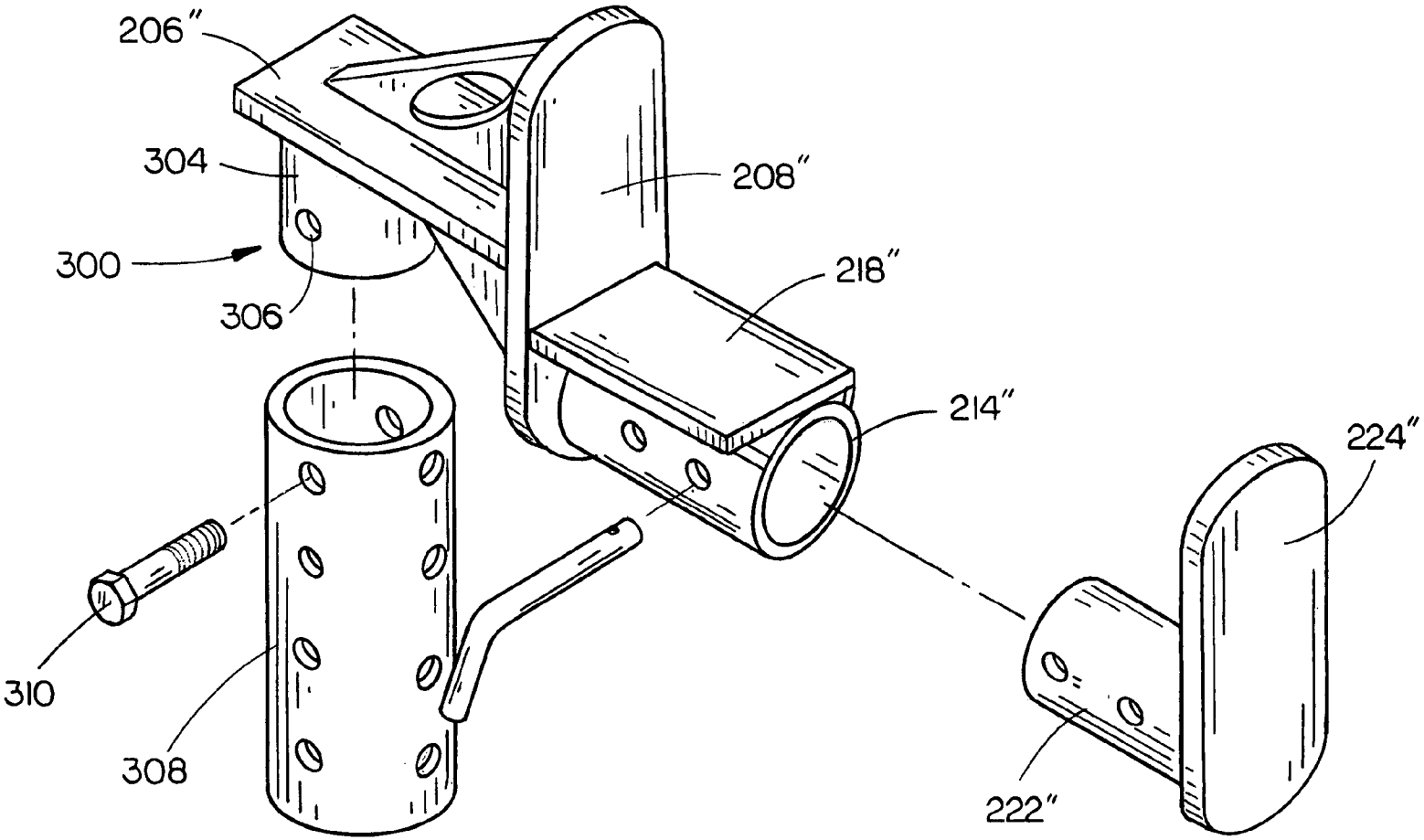
FIG. 9 is an exploded perspective view of a third embodiment of the tool of this invention.
Figure 10:
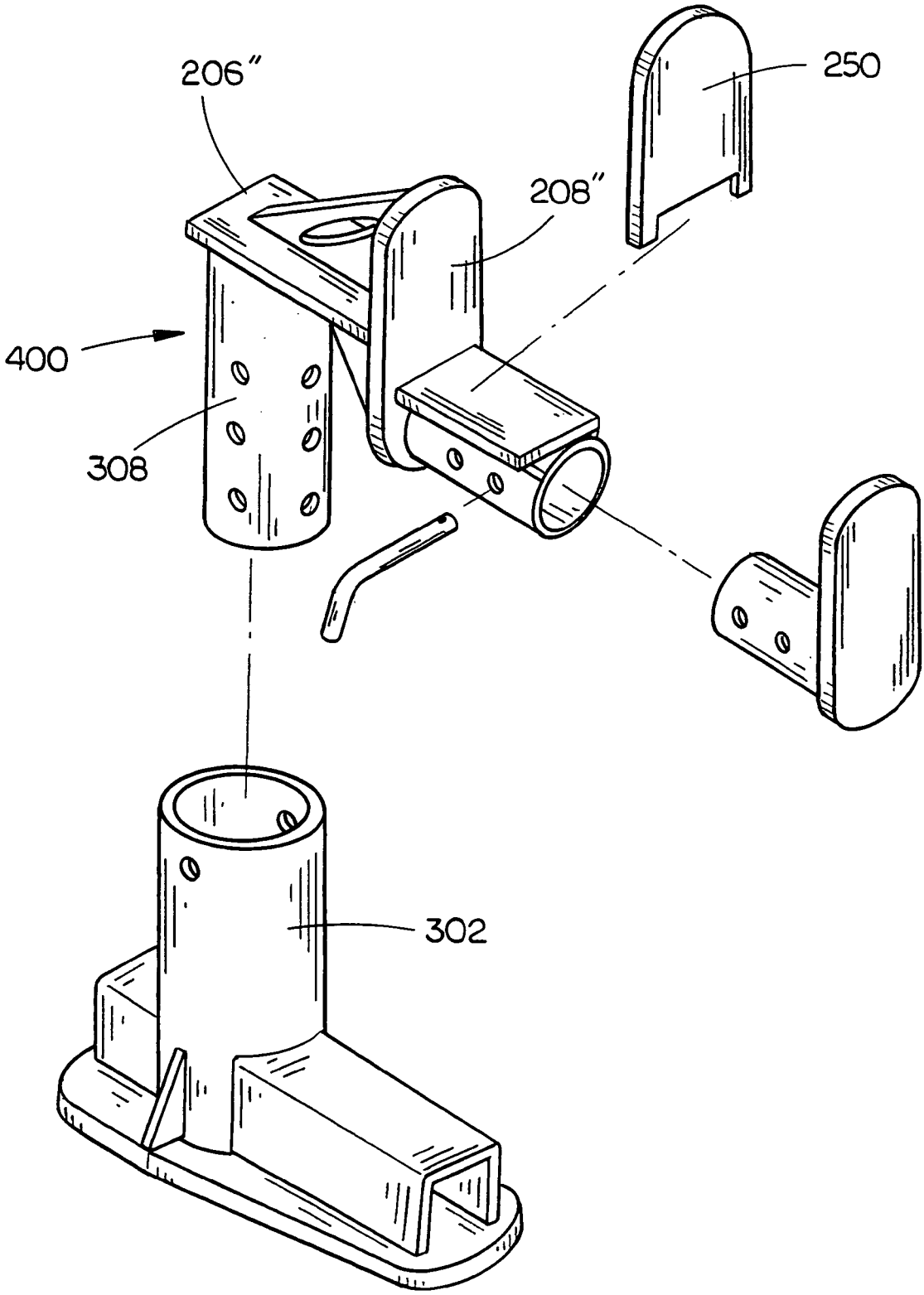
FIG. 10 is an exploded perspective view of a fourth embodiment of the tool of this invention.
Figure 11:
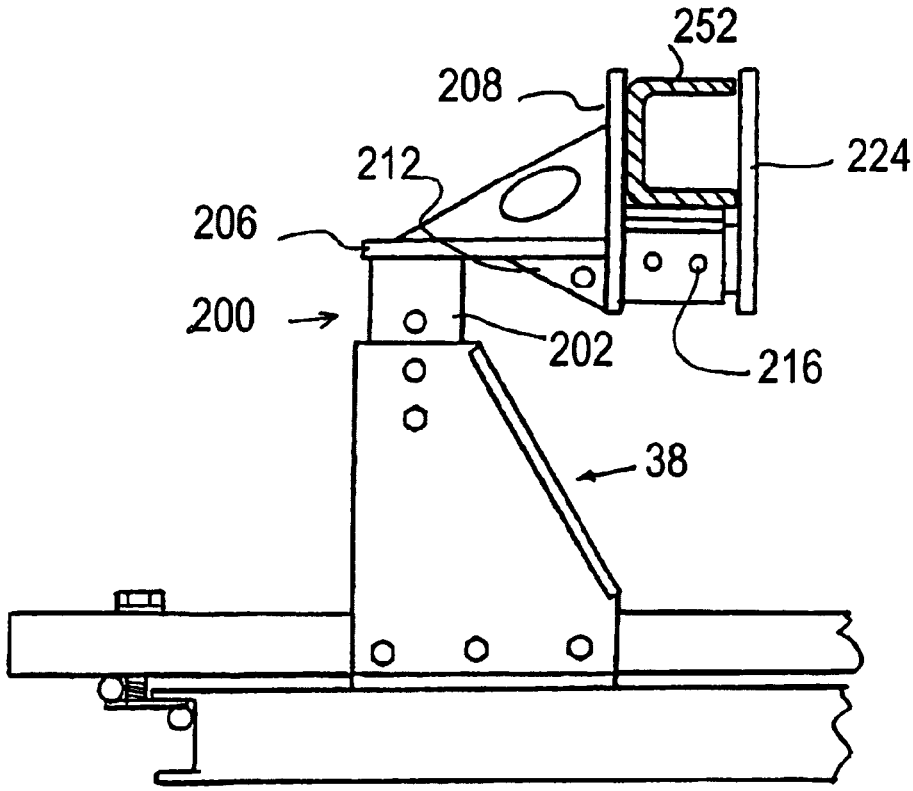
FIG. 11 is a side view illustrating the tool of FIG. 7.
Figure 12:
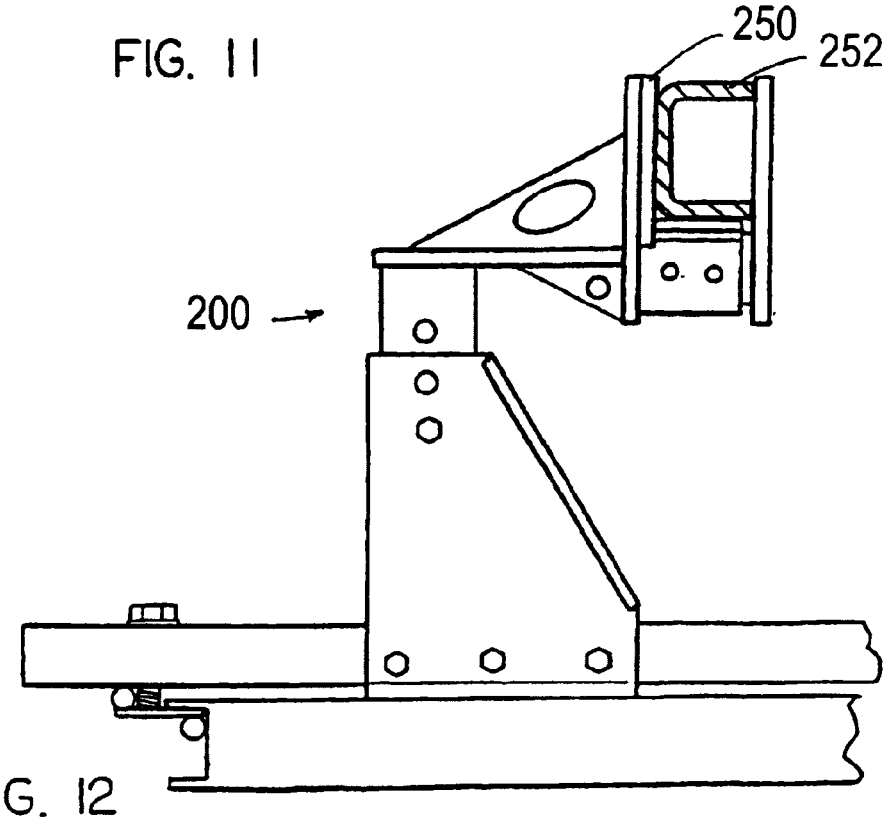
FIG. 12 is a view similar to FIG. 11 except that a shim is utilized therewith.

In FIGS. 7 and 11–12, the reference numeral 200 refers to the first embodiment of the tool while in FIG. 8, the reference numeral 200' refers to the second embodiment of the tool. The numeral 300 refers to a third embodiment of the tool (FIG. 9). In FIG. 10, the numeral 400 refers to a fourth embodiment of the tool. Tool 200 includes a generally vertically disposed socket insert sleeve 202 having a plurality of vertically spaced openings 204 formed therein adapted to receive the inner ends of a bolt member 50 when sleeve 202 is positioned in the socket 46 of the blocking socket 38. The vertical spacing of the openings permits the vertical adjustment of sleeve 202 with respect to blocking socket 38.

Plate or support 206 has its inner end welded to the upper end of sleeve 202 and extends laterally therefrom. A generally vertically disposed plate or support 208 is welded to the end of plate 206, the connection of which is strengthened by the gussets 210 and 212. One end of a hollow tubular member 214 is welded to the lower end of plate 208 and has one or more horizontally spaced openings 216 formed therein. An optional plate or support 218 is welded to the upper end of tubular member 214, as seen in the drawings.

The numeral 220 refers to a tubular member which is slidably and rotatably received within tubular member 214 and which has one or more openings 222 formed therein adapted to selectively register with openings 216 in tubular member 214. Plate or support 224 is welded to the outer end of tubular member 220, as seen in FIG. 7. The plate 224 may be selectively rotated from an upwardly extending position to a downwardly extending position. When plate 224 is in its upright position, it is spaced inwardly of plate 208. When the plate 224 is in its upright position, one of the openings 216 may be aligned with one of the openings 222 to vary the spacing between plates 208 and 224 to accommodate various frame member widths. A pin 225 is selectively extending through and opening 216 and through an opening 222 to lock plate 224 in its upright position.

The tool 200' of FIG. 8 is quite similar to the tool 200 except for the manner in which the tool 200' is secured to the blocking socket 38. For that reason, the structure of tool 200' which is identical to structure on tool 200 will not be described in detail but will be designated by "'". Thus, plate 208', tubular member 214', openings 216', tubular member 220', openings 222' and plate 224' are identical to plate 208, tubular member 214, openings 216, tubular member 220, openings 222 and plate 224, respectively.

A post or support 226 is positioned within socket 46 of blocking socket 38 and has a reduced thickness portion 228 at its upper end which defines a shoulder 230. The height of the support 226 may be selectively varied by simply providing several supports 226 of different lengths to accommodate different frame heights. Tool 200' includes sleeve or tube 232 which is selectively positioned on reduced thickness portion 228 of support 226 with the lower end of the tube 232 engaging shoulder 230. Normally, a spacer 234 will be welded to one side of tube 232, as seen in the drawings. The plate 208' is welded to the side of spacer 234.

FIG. 9 illustrates a third embodiment 300 of the tool which is designed to be used with holding systems which have round sockets 302 rather than the square sockets described above. Tool 300 includes plate 206" which is identical to plates 206 and 206' previously described and shown. A pipe stub 304 is welded to the underside of plate 208" and has an opening 306 extending therethrough. The numeral 308 refers to a tubular support which is adapted to be inserted into the round socket 302. The upper end of support 308 is adapted to receive pipe stub 304, as seen in the drawings, and to be secured thereto by bolt 310. The remaining structure of tool 300 is identical to the embodiments previously described above with the designed "'" referring to identical structure. The height of the tool 300 may be selectively varied by simply substituting different height tubular supports 308. Tubular support 308 could be welded to plate 208" if desired, as shown in FIG. 10, but if a different height tool is required, an entire tool 300 would be required rather than just the tubular support 308. The numeral 250 refers to a shim which may be used with the tools as illustrated in FIGS. 10 and 12.

It can be seen that more tools have been provided which are ideally suited for use with vehicle holding systems. The tools are adapted to conveniently be positioned around a frame member 252, as illustrated in FIGS. 11 and 12, to securely hold the frame. The tools are easily mounted in the holding sockets and may be adjusted to accommodate various frame widths or thicknesses.

Thus it can been seen that the invention accomplishes at least all of its stated objectives.

I claim:

1. A tool for use with a vehicle holding system which is a part of a vehicle frame straightening apparatus including one or more upstanding supports having a vertically disposed socket at its upper end, comprising:

a first upstanding socket insert sleeve adapted to be inserted into the socket;

a first support, having inner and outer ends, secured at its inner end to the upper end of said sleeve and extending generally horizontally therefrom;

a second support, having upper and lower ends, secured to the outer end of said first support;

a first hollow tubular member secured to said second support and extending generally horizontally therefrom;

a second tubular member selectively rotatably mounted within said first tubular member and having inner and outer ends;

a third support secured to the outer end of said second tubular member and extending generally transversely with respect thereto;

and a pin selectively connecting said first and second tubular members so that said second and third supports define a frame receiving socket adapted to receive a vehicle frame therein.

2. The tool of claim 1 wherein said second tubular member is selectively positioned with respect to said first tubular member to vary the distance between said second and third supports.

3. The tool of claim 1 wherein said first socket insert sleeve is selectively vertically adjustably secured to the upstanding support of the vehicle frame straightening apparatus.

4. The tool of claim 3 wherein the socket has a quadrilateral-shaped cross-section and therein said first socket insert sleeve has a quadrilateral-shaped cross-section.

5. The tool of claim 1 wherein the socket has a quadrilateral-shaped cross-section and wherein said first socket insert sleeve has a quadrilateral-shaped cross-section.

6. The tool of claim 1 wherein a bolt member connects said first socket insert sleeve to the upstanding support of the vehicle frame straightening apparatus.

7. The tool of claim 1 wherein a fourth support is secured to said first tubular member at the upper end thereof.

8. The tool of claim 1 wherein said first, second and third supports each comprise a plate.

9. The tool of claim 7 wherein said first, second, third and fourth supports each comprise a plate.

10. The tool of claim 1 wherein said sleeve has a round cross-section.

11. The tool of claim 1 wherein a pipe stub is secured to said first support and extends downwardly therefrom and wherein said sleeve is selectively removably secured to said pipe stub.

12. A tool for use with a vehicle holding system which is a part of a vehicle frame straightening apparatus including one or more upstanding supports having a vertically disposed socket at its upper end, comprising:

a first upstanding support, having upper and lower ends, adapted to be inserted into the socket;

a first hollow sleeve, having inner and outer ends and upper and lower ends, positioned on the upper end of said first support;

a second generally vertically disposed support, having upper and lower ends, secured to said first hollow sleeve at said outer end thereof;

a first hollow tubular member secured to said second support and extending generally horizontally therefrom;

a second tubular member selectively rotatably mounted within said first tubular member and having inner and outer ends;

a third support secured to the outer end of said second tubular member and extending generally transversely with respect thereto;

and a pin selectively connecting said first and second tubular members so that said second and third supports define a frame receiving socket adapted to receive a vehicle frame therein.

13. The tool of claim 12 wherein said second tubular member is selectively positioned with respect to said first tubular member to vary the distance between said second and third supports.

14. The tool of claim 13 wherein a spacer is provided between said first hollow sleeve and said second support.

15. The tool of claim 12 wherein said first support has a quadrilateral cross-section and wherein said first hollow sleeve has a quadrilateral cross-section.

16. The tool of claim 12 wherein said second and third supports each comprise a plate.

17. The tool of claim 12 further including a shim selectively removably positioned between said second and third supports.

18. A tool for use with a vehicle holding system which is a part of a vehicle frame straightening apparatus including one or more upstanding supports having a vertically disposed socket at its upper end, comprising:

a first upstanding support, having upper and lower ends, adapted to be inserted into the socket;

a first hollow sleeve, having inner and outer ends and upper and lower ends, positioned on the upper end of said first support;

a second generally vertically disposed support, having upper and lower ends, secured to said first hollow sleeve at said outer end thereof;

a first hollow tubular member secured to said second support and extending generally horizontally therefrom;

a second tubular member selectively rotatably mounted within said first tubular member and having inner and outer ends;

a third support secured to the outer end of said second tubular member and extending generally transversely with respect thereto;

and a pin selectively connecting said first and second tubular members so that said second and third supports define a frame receiving socket adapted to receive a vehicle frame therein;

said first upstanding support being provided with a reduced thickness portion defining a shoulder and wherein said first hollow sleeve is positioned on said reduced thickness portion so that said lower end of said first sleeve engages said shoulder.

* * * * *